US006633204B1

(12) United States Patent
Makino et al.

(10) Patent No.: US 6,633,204 B1
(45) Date of Patent: Oct. 14, 2003

(54) NONRECIPROCAL CIRCUIT DEVICE AND COMMUNICATION APPARATUS

(75) Inventors: Toshihiro Makino, Matto (JP); Hiroki Dejima, Kanazawa (JP); Takashi Hasegawa, Kanazawa (JP); Masakatsu Mori, Ishikawa-ken (JP); Takahiro Jodo, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/557,456

(22) Filed: Apr. 24, 2000

(30) Foreign Application Priority Data

Apr. 23, 1999 (JP) ..... 11-117254
Feb. 16, 2000 (JP) ..... 2000-038459

(51) Int. Cl.[7] ..... H01P 1/383; H01P 1/36
(52) U.S. Cl. ..... 333/1.1; 333/24.2
(58) Field of Search ..... 333/1.1, 24.2; H01P 1/36, 1/383

(56) References Cited

U.S. PATENT DOCUMENTS 4,101,850 A * 7/1978 Dworsky et al. ..... 333/24.2

FOREIGN PATENT DOCUMENTS

| | | | | |
|---|---|---|---|---|
| EP | 0903801 A2 | | 3/1999 | |
| JP | 10303605 A | * | 11/1998 | ..... 333/1.1 |
| JP | 11-55009 | | 2/1999 | |
| JP | 11-068411 A | | 3/1999 | |
| JP | 11-097910 A | | 4/1999 | |

OTHER PUBLICATIONS

European Search Report dated Feb. 14, 2002 for EP 00 10 8475.

* cited by examiner

*Primary Examiner*—Robert Pascal
*Assistant Examiner*—Stephen E. Jones
(74) *Attorney, Agent, or Firm*—Keating & Bennett, LLP

(57) ABSTRACT

A nonreciprocal circuit device, which includes a permanent magnet; a ferrite to which a DC magnetic field is applied by the permanent magnet; a plurality of center electrodes extending from a first major surface of the ferrite to a second major surface of the ferrite via side surfaces of the ferrite; a ground plate disposed on the second major surface side of the ferrite and electrically connected to the plurality of center electrodes; a plurality of matching capacitors electrically connected between the ground plate and port sections of the plurality of center electrodes respectively; and at least one of the matching capacitors being disposed such that the capacitor electrode face thereof and the ferrite form an angle in a range of 60 degrees to 120 degrees.

11 Claims, 6 Drawing Sheets

NONRECIPROCAL CIRCUIT DEVICE AND COMMUNICATION APPARATUS

BACKGROUND OF THE INVENTION

1. Field of the Invention

The present invention relates to a nonreciprocal circuit device. More particularly, the present invention relates to a nonreciprocal circuit device such as an isolator or a circulator for use in a microwave communication apparatus, and to a communication apparatus using the isolator or circulator.

2. Description of the Related Art

Generally, the function of a lumped-constant type isolator is to pass a signal only in a transmitting direction and to eliminate the transmission of the signal in the reverse direction.

Recently, in mobile communication apparatus, cost-reduction has been strongly demanded as well as miniaturization and weight-reduction. In such a circumstance, miniaturization, weight-reduction and cost-reduction have also been demanded in an isolator.

A lumped-constant type isolator shown in FIG. 10 has been proposed to meet the above demand. The lumped-constant type isolator 11 comprises a terminal case 13 which is made of resin and disposed on a lower yoke 12. The lower yoke 12 is made of magnetic metal and comprises right and left side walls 12*a* and a bottom wall 12*b*. A center electrode assembly 14 is accommodated in the terminal case 13 and an upper yoke 15 made of magnetic metal is placed thereon. Inside the upper yoke 15, a permanent magnet 16 is disposed. The permanent magnet 16 applies a DC magnetic field to the center electrode assembly 14.

The center electrode assembly 14 comprises a microwave ferrite 20 and three center electrodes 21, 22 and 23 disposed on the microwave ferrite 20. The three center electrodes 21–23 cross each other at angles of 120 degrees in an electrically insulated state. Port sections P1, P2 and P3 at first ends of the three center electrodes 21–23 are bent vertically and a shield section 26 which is common to the other ends of the three center electrodes 21–23 is contacted to the lower surface of the ferrite 20. The common shield section 26 substantially covers the lower surface of the ferrite 20, and is connected to the bottom wall 12*b* of the lower yoke 12 through a window 13*a* of the terminal case 13.

Input/Output electrodes 31, 32 and ground terminals 33, 34 are insert molded in the terminal case 13. First ends of the Input/Output electrodes 31, 32 are exposed outside the side wall of the case 13, and the other ends thereof are exposed inside the side wall of the case 13, to thereby form Input/Output connecting sections 18*a*, 18*b* inside the case 13. Similarly, first ends of the ground terminals 33, 34 are exposed outside the side wall of the case 13, and the other ends thereof are exposed inside the side wall of the case 13, to thereby form ground connecting electrode sections 17*a*, 17*b* and 17*c*, 17*d*, respectively.

Each of the port sections P1–P3 of the center electrodes 21–23 is connected to a hot-side capacitor electrode 1 of one of matching capacitors C1, C2 and C3. A cold-side capacitor electrode 2 of each of the matching capacitors C1–C3 is connected to the ground connecting electrode sections 17*a*, 17*b*, 17*c*, 17*d*. One end of a termination resistor R is connected to the hot-side capacitor electrode 1 of the matching capacitor C3, and the other end thereof is connected to the ground connecting electrode section 17*b*. That is, the matching capacitor C3 and the termination resistor R are electrically connected in parallel between the port section P3 of the center electrode 23 and ground. Further, the port sections P1 and P2 are connected to the Input/Output connecting electrode sections 18*a* and 18*b*, respectively.

In the above conventional isolator 11, each of the matching capacitors C1–C3 must be inserted between one of the port sections P1–P3 and one of the ground connecting electrode sections 17*a*, 17*c*, 17*d*, respectively, while holding the capacitor in a vertical orientation. Further, it is necessary to connect the capacitor electrodes 1, 2 of the matching capacitors C1–C3 to the port sections P1–P3 and the ground connecting electrode sections 17*a*, 17*c*, 17*d* by soldering.

However, the isolator 11 has the problem that the process of inserting the matching capacitors C1–C3 between the port sections P1–P3 and the ground connecting electrode sections 17*a*, 17*c*, 17*d* requires much time and effort, because the matching capacitors C1–C3 are small in size and difficult to handle. Further, since the port sections P1–P3 of the center electrodes 21–23 must be bent vertically in one of the initial steps in the assembly process, it is possible for the solder connection between the port sections P1–P3 and the matching capacitors C1–C3 to become unstable because of variations in the bend angle of the port sections P1–P3. Moreover, it is possible for the solder to spill and cause a short-circuit between the hot-side capacitor electrodes 1 and the cold-side capacitor electrodes 2 of the matching capacitors C1–C3, resulting in a defective product.

SUMMARY OF THE INVENTION

To overcome the above described problems, preferred embodiments of the present invention provide a nonreciprocal circuit device and a communication apparatus having high reliability, including a matching capacitor which is easy to assemble.

One embodiment of the present invention provides a nonreciprocal circuit device, comprising: a permanent magnet; a ferrite to which a DC magnetic field is applied by the permanent magnet; a plurality of center electrodes extending from a first major surface of the ferrite to a second major surface of the ferrite via side surfaces of the ferrite; a ground plate disposed on the second major surface side of the ferrite and electrically connected to the plurality of center electrodes; a plurality of matching capacitors electrically connected between the ground plate and port sections of the plurality of center electrodes respectively; and at least one matching capacitor being disposed such that a major surface thereof forms an angle in a range of 60 degrees to 120 degrees with a major surface of the ferrite.

According to the above arrangement, the matching capacitors can be connected between the center electrodes and the ground plate assembled with the ferrite in an initial assembly step. Thus, it becomes possible to handle the matching capacitors integrally with the center electrodes, the ground plate and the ferrite, as one unit. Therefore, mounting the matching capacitors becomes easier.

Further, an insulator for preventing a short circuit may be provided in the vicinity of the portion of the ground plate at which the matching capacitor is connected and in the vicinity of the port section of the center electrode. This insulator prevents an undesirable solder bridge from being formed by spilled solder when the matching capacitor is soldered. By this, for example, a short-circuit between the hot-side capacitor electrode and the cold-side capacitor electrode of the matching capacitor can be prevented.

Further, a communication apparatus according to the present invention has a lower manufacturing cost and higher reliability because the apparatus is provided with a nonreciprocal circuit device having the above described arrangement.

Also disclosed is a method of assembling the nonreciprocal circuit device.

Other features and advantages of the present invention will become apparent from the following description of embodiments of the invention which refers to the accompanying drawings.

DESCRIPTION OF EMBODIMENTS OF THE INVENTION

First Embodiment, FIG. 1–FIG. 6

Figure 1:
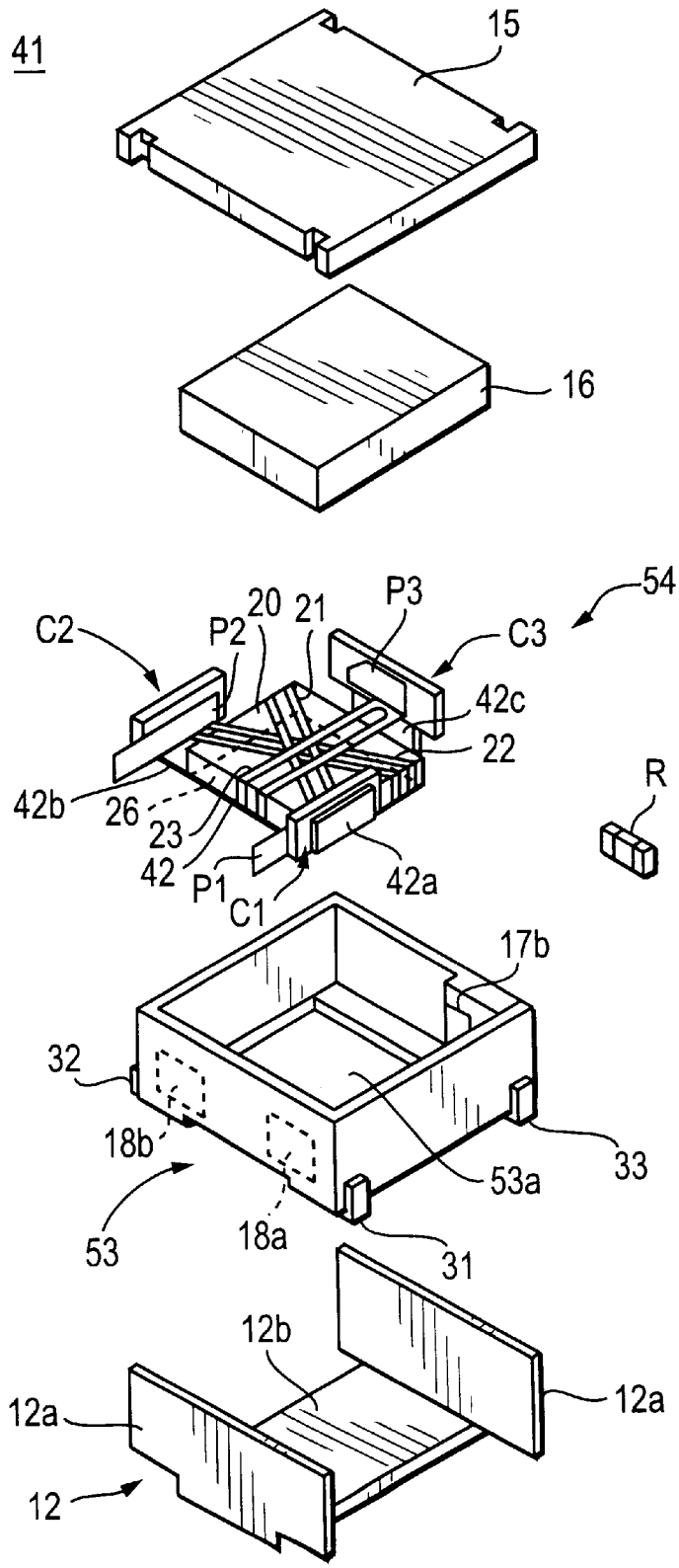
FIG. 1 is an exploded perspective view of a nonreciprocal circuit device of a first embodiment according to the present invention.
Figure 10:
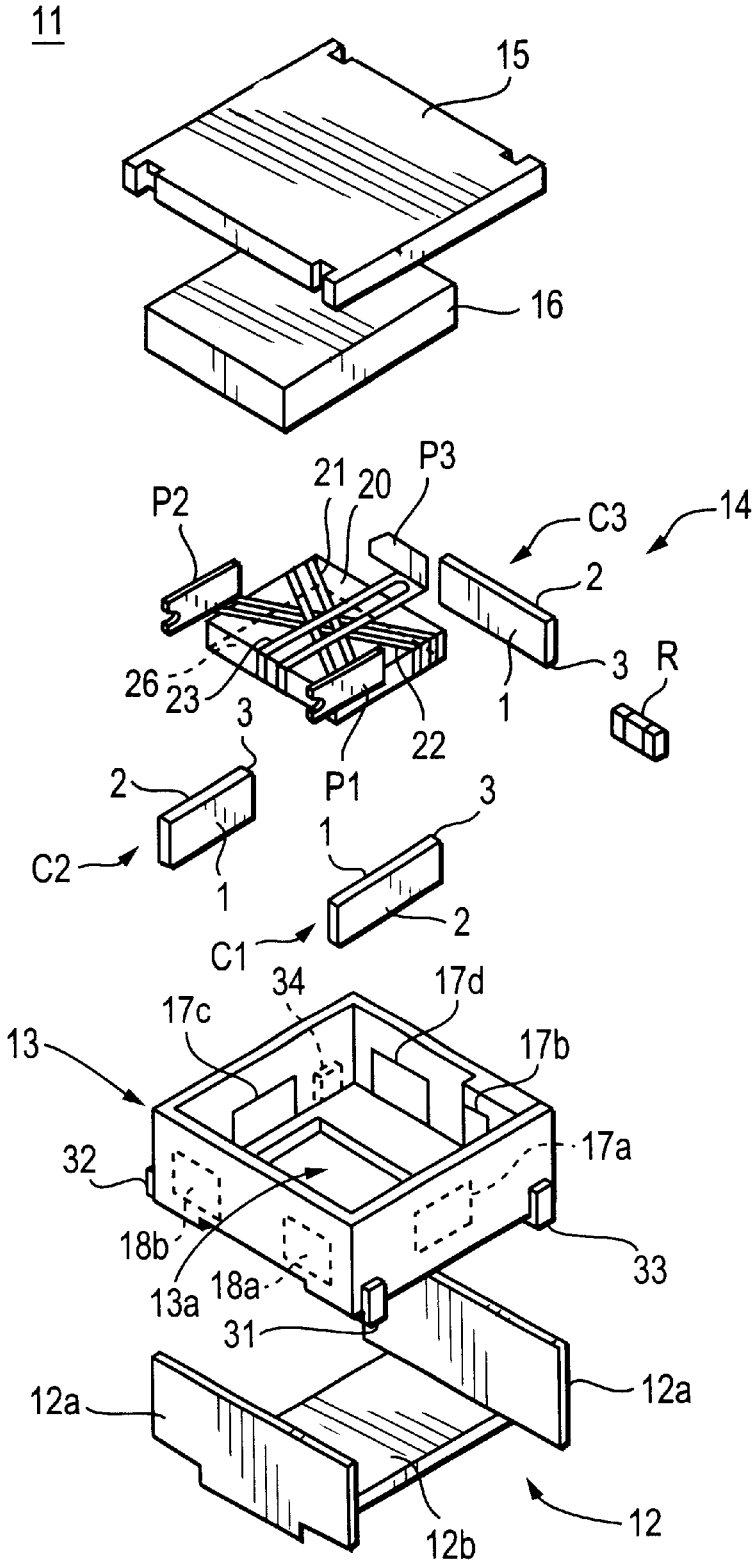
FIG. 10 PRIOR ART
FIG. 10 is an exploded perspective view of a conventional nonreciprocal circuit device.

FIG. 1 shows an exploded perspective view of a first embodiment of a nonreciprocal circuit device of the present invention. The nonreciprocal circuit device 41 is one which the present invention is applied to the lumped-constant type isolator 11 explained by referring to FIG. 10. As shown in FIG. 1, the lumped-constant type isolator 41 comprises a lower yoke 12, a terminal case 53 made of resin, a center electrode assembly 54, a permanent magnet 16 and an upper yoke.

The lower yoke 12 is made of magnetic metal and comprises right and left side walls 12*a* and 12*b*. The terminal case 53 is disposed on the lower yoke 12, the center electrode assembly 54 is accommodated in the terminal case 13 and an upper yoke 15 made of magnetic metal is placed thereon. On the lower major surface of the upper yoke 15, the permanent magnet 16 is disposed. The permanent magnet 16 applies a DC magnetic field to the center electrode assembly 54. A magnetic circuit is formed by the lower yoke 12, the center electrode assembly 54 and the upper yoke 15.

Figure 2:
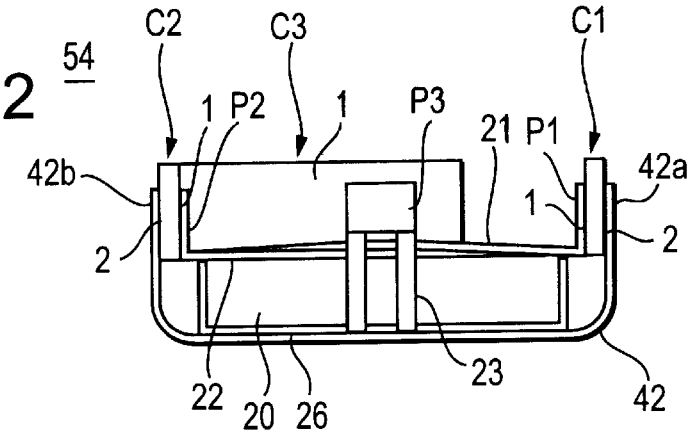
FIG. 2 is a front view of a center electrode assembly of the nonreciprocal circuit device of FIG. 1.
Figure 3:
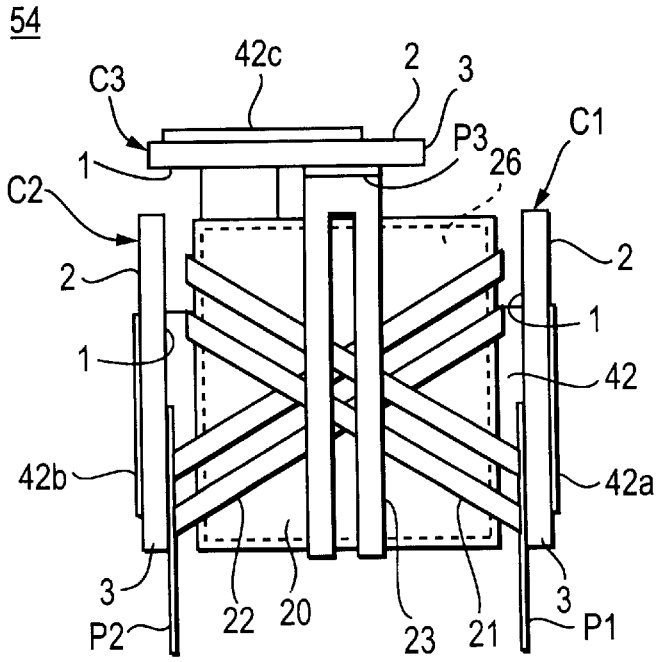
FIG. 3 is a plan view of the center electrode assembly of FIG. 2.

The center electrode assembly 54 comprises a microwave ferrite 20 and three center electrodes 21–23 disposed on the upper surface (first major surface) of the microwave ferrite 20, as shown in FIG. 2 and FIG. 3. The three center electrodes 21 23 cross each other at angles of 120 degrees in an electrically insulated state. Port sections P1–P3 at first ends of the three center electrodes 21–23 are bent vertically and a shield section 26 which is common to the other ends of the three center electrodes 21–23 is contacted to the lower surface (second major surface) of the ferrite 20. The common shield section 26 substantially covers the lower surface of the ferrite 20.

A ground plate 42 is disposed on the lower surface side of the ferrite 20 and electrically connected to the common shield section of the center electrodes 21–23 by face-contact (by utilizing solder, electroconductive adhesive, etc. if necessary). Capacitor connecting sections 42*a*, 42*b*, 42*c* are extended from the end portion of the ground plate 42 and stand so as to be parallel to the port sections P1–P3 of the center electrodes 21–23. The ground plate 42 is grounded by connecting it to the bottom wall 12*b* of the lower yoke 12 through the window 53*a* of the terminal case 43. 20 Hot-side capacitor electrodes 1 of matching capacitors C1–C3 are connected to the port sections P1–P3 by soldering, and cold-side capacitor electrodes 2 thereof are connected to the capacitor connecting sections 42*a*, 42*b*, 42*c* of the ground plate 42 by soldering. The matching capacitors C1–C3 are disposed such that the surfaces of the capacitor electrodes 1, 2 and the upper surface of the ferrite 20 form an angle in a range from 60 degrees to 120 degrees. In the case of this first embodiment, the angle is set at 90 degrees. Each of the matching capacitors C1–C3 is a single-plate type capacitor in which capacitor electrodes 1, 2 are formed on both surfaces of a dielectric substrate 3.

Figure 4:
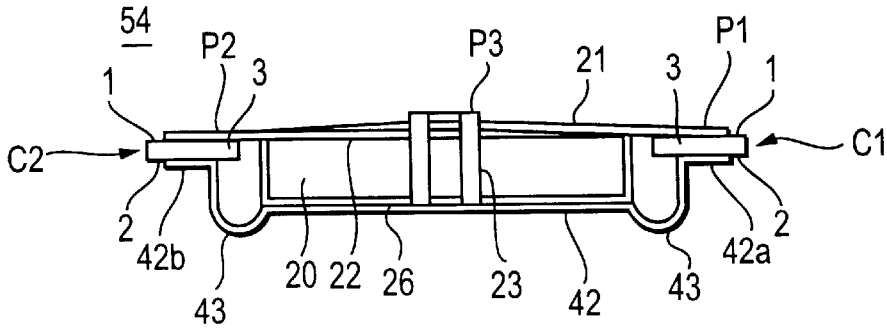
FIG. 4 is a view explaining the assembly of the matching capacitors in the center electrode assembly of FIG. 2.

Mounting of the matching capacitors C1–C3 can be performed as indicated in FIG. 4, for example. That is, bend portions 43 are provided at the base portion of the ground plate 42 so that the device shown in FIG. 4 can be shaped as shown in FIG. 2. After applying soldering paste to the capacitor connecting sections 42*a*–42*c* of the ground plate 42, the matching capacitors C1–C3 are mounted such that the cold-side capacitor electrodes 2 are at the underside.

Further, after applying soldering paste on the hot-side capacitor electrodes 1 of the matching capacitors C1–C3, the ferrite 20 including the attached center electrodes 21–23 is mounted from above. The common shield section 26 of the center electrodes 21–23 is face-contacted to the upper surface of the ground plate 42, and the port sections P1–P3 are face-contacted to the hot-side capacitor electrodes 1 of the matching capacitors C1–C3, respectively. The solder paste is heated in this state, and the matching capacitors C1–C3 are soldered. Next, the capacitor connecting sections 42*a*–42*c* and the port sections P1–P3 are bent so as to dispose the matching capacitors C1–C3 with the surfaces of the capacitor electrodes 1, 2 and the upper surface of the ferrite 20 forming an angle in a range of 60 degrees to 120 degrees. Accordingly, the center electrode assembly 54 is obtained.

Input/Output electrodes 31, 32 and ground terminals 33, 34 are insert molded in the terminal case 53. First ends of the Input/Output electrodes 31, 32 are exposed outside the side wall of the case 53, and the other ends thereof are exposed inside the side wall of the case 53, to form Input/Output connecting sections 18*a*, 18*b*. Similarly, a first end of the ground terminal 33 is exposed outside the side wall of the case 53, and the other end thereof is exposed inside the side wall of the case 53, to form ground connecting electrode section 17*b*.

Figure 5:
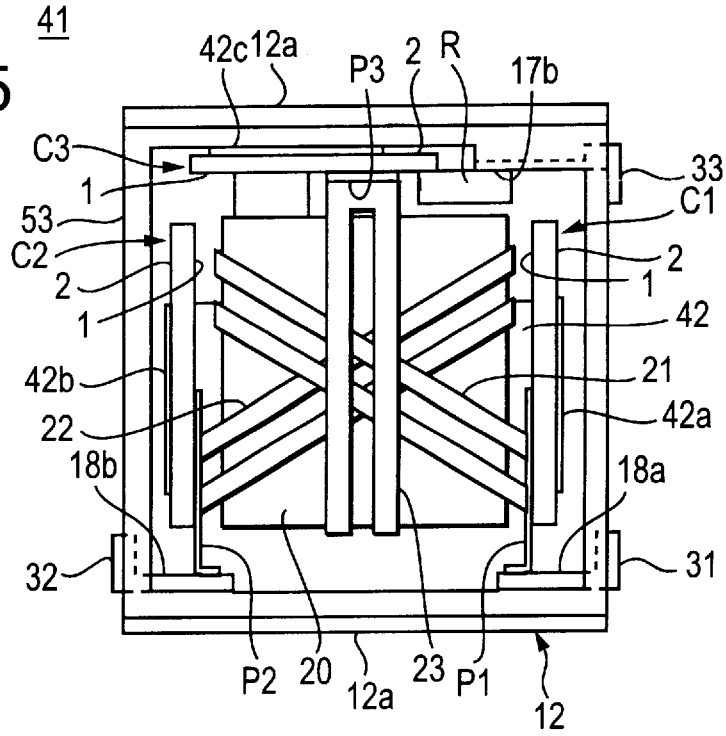
FIG. 5 is a view showing the inside structure of the nonreciprocal circuit device of FIG. 1.
Figure 6:
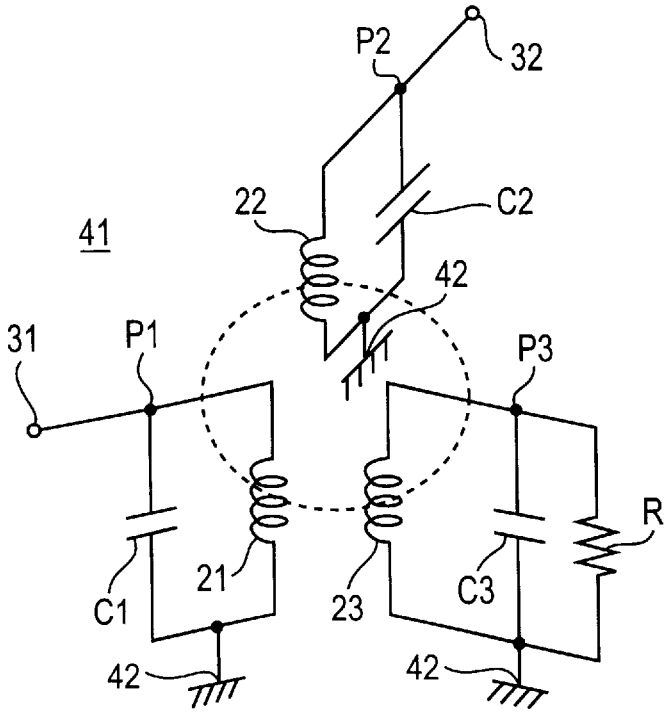
FIG. 6 is an equivalent circuit diagram of the nonreciprocal circuit device of FIG. 1.

As shown in FIG. 5, the center electrode assembly 54 and the termination resistor R are accommodated in the terminal case 53 having a structure as described above. The port sections P1, P2 of the center electrodes 21, 22 are connected to the Input/Output connecting electrode sections 18*a*, 18*b* by soldering, etc. One end of the termination resistor R is connected to the ground connecting electrode section 17*b*, and the other end thereof is connected to the hot-side capacitor electrode 1 of the matching capacitor C3. The equivalent circuit diagram of the isolator 41 is shown in FIG. 6.

In the isolator 41 having a structure as described above, since the matching capacitors C1–C3 are mounted between the port sections P1–P3 of the center electrodes 21–23 and the capacitor connecting sections 42*a*–42*c* of the ground plate 42 respectively, the matching capacitors C1–C3, the center electrodes 21–23 and the ferrite 20 can be handled as one unit. According to this arrangement, the process in which the small-sized matching capacitors C1–C3, which are difficult to handle, are mounted in a vertical plane, is eliminated, and thereby the manufacture of the isolator 41 becomes easier.

Further, in the first embodiment, after connecting the matching capacitors C1–C3 to the port sections P1–P3 and the capacitor connecting sections 42*a*–42*c*, the matching capacitors C1–C3 are disposed vertically by bending the port sections P1 P3 and the capacitor connecting sections 42*a*–42*c*. Accordingly, compared with the conventional isolator 11 (see FIG. 10) in which the port section must be bent before connecting the matching capacitor, the soldering of the port sections P1 P3 and the matching capacitors C1–C3 can be performed with reliability, and thereby the connection reliability is improved.

Further, since each of the cold-side electrodes 2 of the matching capacitors C1–C3 is grounded via the ground plate 42, the ground connecting electrode sections 17*a*, 17*b*, 17*c* formed in the conventional terminal case 13 (see FIG. 10) can be omitted. Accordingly, the structure of the terminal case 53 becomes simple and cost-reduction can be realized.

Figure 7:
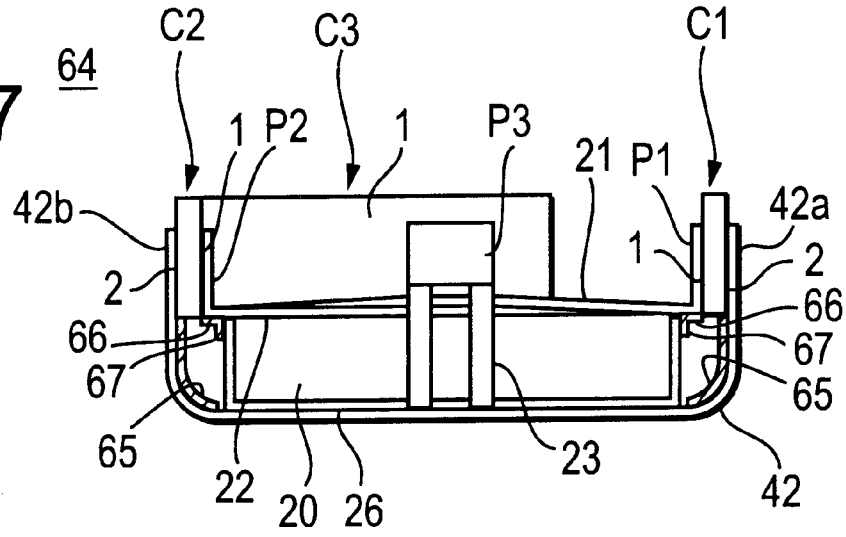
FIG. 7 is a front view of the center electrode assembly of the nonreciprocal circuit device of a second embodiment according to the present invention.
Figure 8:
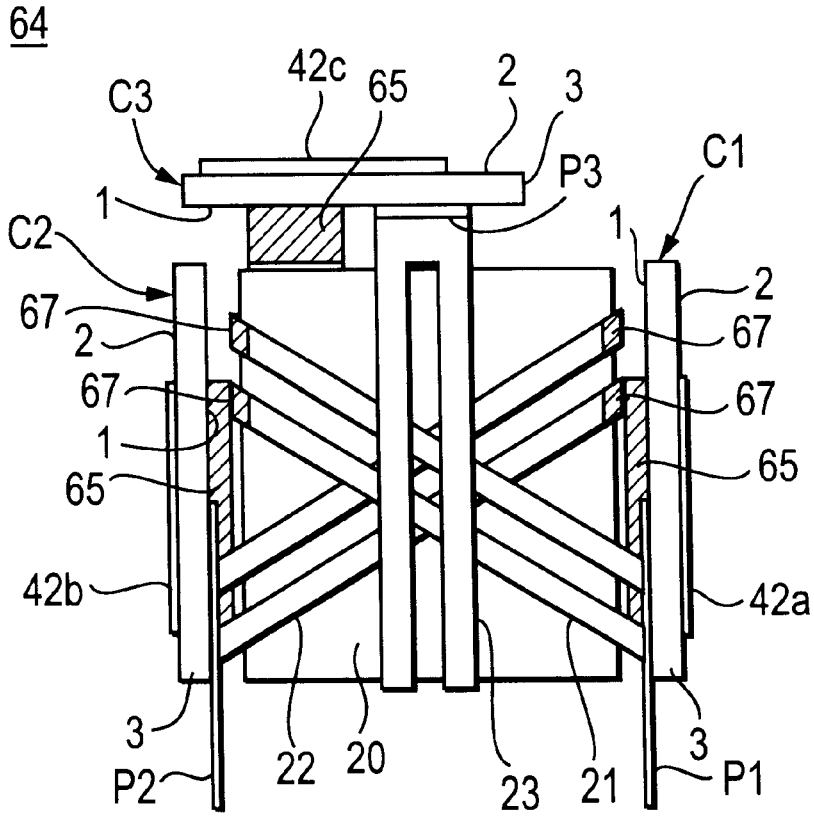
FIG. 8 is a plan view of the center electrode assembly shown in FIG. 7.

Second Embodiment, FIG. 7 and FIG. 8

A center electrode assembly 64 according to another embodiment of the nonreciprocal circuit device of the present invention is shown in FIG. 7 and FIG. 8. In the center electrode assembly 64, insulators 65, 66 (indicated by hatching in FIG. 7 and FIG. 8) are provided for preventing solder bridges.

The insulator 65 is provided on the ground plate 42 in the vicinity of where the matching capacitors C1–C3 are connected. The insulator 66 is provided in the vicinity of the port sections P1–P3 of the center electrodes 21–23. The insulators 65, 66 prevent a solder bridge and thereby prevent a short-circuit between the hot-side electrodes 1 of the matching capacitors C1–C3 and the ground electrode 42 or a short-circuit between the hot-side electrodes 1 and the cold-side electrodes 2. Further, since a solder bridge is eliminated by the insulators 65, 66, the positioning accuracy of the matching capacitors is improved.

Moreover, in the second embodiment, to eliminate a short-circuit between the hot-side electrodes 1 when the matching capacitors C1, C2 are held in a vertical orientation and the center electrodes 21, 22, an insulator 67 is provided where the center electrodes 21, 22 and the hot-side electrodes 1 oppose each other. By this, an isolator having higher reliability can be obtained.

Figure 9:
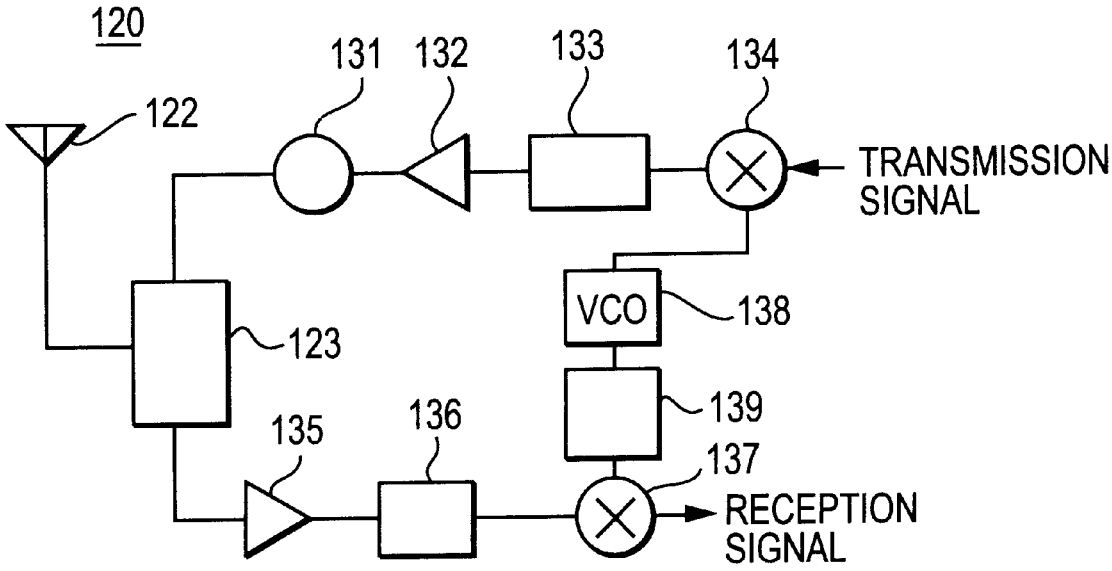
FIG. 9 is a block diagram showing one embodiment of a communication apparatus according to the present invention.

Third Embodiment, FIG. 9

A third embodiment of the invention will be explained, taking a mobile phone as an example of a communication apparatus of the present invention.

FIG. 9 is a block diagram of an RF part of a circuit in a mobile phone 120. In FIG. 9, 122 denotes an antenna element, 123 denotes a duplexer, 131 denotes a transmission-side isolator, 132 denotes a transmission-side amplifier, 133 denotes a transmission-side band-pass filter, 134 denotes a transmission-side mixer, 135 denotes a reception-side amplifier, 136 denotes a reception-side inter-stage band-pass filter, 137 denotes a reception-side mixer, 138 denotes a voltage control oscillator (VCO), and 139 denotes a local band-pass filter.

Here, the lumped-constant type isolator of the first and second embodiments can be used as the transmission-side isolator 131. By attaching this isolator, a mobile phone with low-cost and high-reliability cane be realized.

Other Embodiment

The present invention is not restricted to the above described embodiments. It is possible to have various arrangements within the scope of the subject matter of the present invention.

For example, in the above first and second embodiments, the mounting of all of the matching capacitors C1–C3 is longitudinal, i.e., the capacitor electrode surfaces thereof are perpendicular to the horizontal surface. However, it is not necessary to mount all of the matching capacitors C1–C3 longitudinally. Two of the matching capacitors C1–C2 may be mounted longitudinally and the other one of the matching capacitors C3 may be mounted horizontally, in which the capacitor electrode surface thereof is parallel to the horizontal surface. That is, the advantages of the invention, such as saving space, reducing costs, and facilitating assembly, are obtained as long as at least one of the matching capacitors is disposed with the capacitor electrode face thereof forming an angle with the ferrite in a range of 60 degrees to 120 degrees.

Further, the mounting of the matching capacitors C1–C3 can be performed by electroconductive adhesive instead of by soldering. The matching capacitors C1–C3 may be monolithic-type capacitors. Further, the present invention is also applicable to a nonreciprocal circuit device other than an isolator for use in other high-frequency components such as a circulator.

As is apparent from the above description, according to the present invention, since matching capacitors are mounted between center electrodes attached to a ferrite and a ground plate, the matching capacitors can be treated as one unit with the center electrodes, the ground plate and the ferrite. Accordingly, mounting of the small-sized matching capacitors, which are difficult to handle, becomes easier. The matching efficiency of the nonreciprocal circuit device is drastically improved, and thereby costs can be reduced. As a result, cost-reduction of a communication apparatus can be realized.

Further, by providing an insulator for preventing a solder bridge at the portion of the ground plate where the matching capacitor is connected and in the vicinity of the port section of the center electrode, unnecessary short-circuits are eliminated, and thereby a nonreciprocal circuit device and a communication apparatus with higher reliability can be obtained.

While the invention has been particularly shown and described with reference to preferred embodiments thereof, it will be understood by those skilled in the art that the foregoing and other changes in form and details may be made therein without departing from the spirit of the invention.

What is claimed is:

1. A nonreciprocal circuit device, comprising:

a yoke comprising a magnetic material, said yoke enclosing:

a permanent magnet;

a ferrite to which a DC magnetic field is applied by the permanent magnet;

a plurality of center electrodes extending via side surfaces of the ferrite, from a first major surface of the ferrite to a shield section of said center electrodes which is disposed at a second major surface of the ferrite, said center electrodes having respective port sections at ends thereof;

a ground plate disposed on the second major surface of the ferrite and electrically connected to the shield section of the center electrodes, said ground plate having a plurality of connecting sections which correspond respectively to said port sections of said center electrodes;

a plurality of matching capacitors each being sandwiched between and directly connected to a respective connecting section of the ground plate and a corresponding one of the port sections of the plurality of center electrodes, each of the matching capacitors having a pair of electrodes on major surfaces of said matching capacitor connected respectively to the corresponding connecting section and port section; and at least one of the matching capacitors being disposed such that the respective major surfaces thereof and the ferrite form an angle in a range of 60 degrees to 120 degrees; wherein said ground plate is disposed under the ferrite, said plurality of center electrodes are disposed on said ground plate and said ground plate is directly connected to the shield section on the second major surface of the ferrite.

2. The nonreciprocal circuit device according to claim 1, further comprising an insulator disposed in the vicinity of the ground plate and said at least one matching capacitor so as to prevent a solder bridge between the ground plate and said at least one matching capacitor due to spilled solder.

3. The nonreciprocal circuit device according to claim 2, further comprising an insulator disposed in the vicinity of the port section of the center electrode corresponding to said at least one matching capacitor, for preventing a solder bridge between said portion section and said at least one matching capacitor due to spilled solder.

4. The nonreciprocal circuit device according to claim 1, further comprising an insulator disposed in the vicinity of the port section of the center electrode corresponding to said at least one matching capacitor, for preventing a solder bridge between said port section and said at least one matching capacitor due to spilled solder.

5. A communication device comprising:

a high-frequency comprising at lest one of a transmission circuit and a reception circuit, and connected to said high-frequency circuit, a nonreciprocal circuit device comprising:

a yoke comprising a magnetic material, said yoke enclosing:

a permanent magnet;

a ferrite to which a DC magnetic field is applied by the permanent magnet;

a plurality of center electrodes extending via side surfaces of the ferrite, from a first major surface of the ferrite to a shield section of said center electrodes which is disposed at a second major surface of the ferrite, said center electrodes having respective port sections at ends thereof;

a ground plate disposed on the second major surface of the ferrite and electrically connected to the shield section of the center electrodes, said ground plate having a plurality of connecting sections which correspond respectively to said port sections of said center electrodes;

a plurality of matching capacitors each being sandwiched between and directly connected to a respective connecting section of the ground plate and a corresponding one of the port sections of the plurality of center electrodes, each of the matching capacitors having a pair of electrodes on major surfaces of said matching capacitor connected respectively to the corresponding connecting section and port section; and at least one of the matching capacitors being disposed such that the respective major surfaces thereof and the ferrite form an angle in a range of 60 degrees to 120 degrees; wherein said ground plate is disposed under the ferrite, said plurality of center electrodes are disposed on said ground plate, and said ground plate is directly connected to the shield section on the second major surface of the ferrite.

6. The nonreciprocal circuit device according to claim 5, further comprising an insulator disposed in the vicinity of the ground plate and said at least one matching capacitor so as to prevent a solder bridge between the ground plate and said at least one matching capacitor due to spilled solder.

7. The nonreciprocal circuit device according to claim 6, further comprising an insulator disposed in the vicinity of the port section of the center electrode corresponding to said at least one matching capacitor, for preventing a solder bridge between said portion section and said at least one matching capacitor due to spilled solder.

8. The nonreciprocal circuit device according to claim 5, further comprising an insulator disposed in the vicinity of the port section of the center electrode corresponding to said at least one matching capacitor, for preventing a solder bridge between said port section and said at least one matching capacitor due to spilled solder.

9. A nonreciprocal circuit device, comprising:

a yoke comprising a magnetic material;

a permanent magnet; and a unitary center electrode assembly comprising:

a ferrite;

a plurality of center electrodes extending via side surfaces of the ferrite, from a first major surface to a shield section of said center electrodes which is disposed at a second major surface of the ferrite, said center electrodes having respective port sections at ends thereof;

a ground plate attached to the second major surface of the ferrite and electrically connected to the shield section of the center electrodes, said ground plate having a plurality of connecting sections which correspond respectively to said port sections of said center electrodes; and a plurality of matching capacitors each being sandwiched between and directly connected to respective connecting portions of the ground plate and a corresponding one of the port sections of the plurality of center electrodes, each of the matching capacitors having a pair of electrodes on major surfaces of said matching capacitor connected respectively to the corresponding connecting section and port section;

said permanent magnet and said unitary center electrode assembly being disposed in said yoke; wherein said ground plate is disposed under the ferrite, said plurality of center electrodes are disposed on said ground plate, and said ground plate is directly connected to the shield section on the second major surface of the ferrite.

10. A method of assembling a nonreciprocal circuit device, comprising the steps of:

assembling a center electrode assembly by the steps of:

providing a ferrite;

attaching to the ferrite a plurality of center electrodes extending via side surfaces of the ferrite, from a first major surface to a shield section of said center electrodes which is disposed at a second major surface of the ferrite, said center electrodes having respective port sections at ends thereof;

attaching a ground plate to the second major surface of the ferrite and electrically connecting said ground plate to the shield section of the center electrodes, said ground plate having a plurality of connecting sections which correspond respectively to said port section of said center electrodes;

bending at least one of said connecting sections of said ground plate to define an angle of 60 degrees to 120 degrees with respect to said second major surface of said ferrite;

electrically connecting and sandwiching each one of a plurality of matching capacitors between a respective connecting section of said ground plate and a corresponding one of the port sections of the plurality of center electrodes, each of the matching capacitors having a pair of electrodes on major surfaces of said matching capacitor connected respectively to the corresponding connecting section and port section;

whereby at least one of the matching capacitors is disposed such that the respective major surfaces thereof and the ferrite form an angle in a range of 60 degrees to 120 degrees; and disposing said central electrode assembly inside a yoke which comprises a magnetic material; wherein said bending step is performed after said step of electrically connecting and sandwiching said matching capacitors between the respective connecting section and the corresponding port section.

11. The method according to claim 10, further comprising the step of disposing a permanent magnet inside said yoke.

* * * * *